US008967227B2

(12) United States Patent
Chou

(10) Patent No.: US 8,967,227 B2
(45) Date of Patent: Mar. 3, 2015

(54) ROLLER CURTAIN FIXING BRACKET ASSEMBLY

(71) Applicant: Tser Wen Chou, Taipei (TW)

(72) Inventor: Tser Wen Chou, Taipei (TW)

( * ) Notice: Subject to any disclaimer, the term of this patent is extended or adjusted under 35 U.S.C. 154(b) by 16 days.

(21) Appl. No.: 13/905,059

(22) Filed: May 29, 2013

(65) Prior Publication Data

US 2014/0174678 A1 Jun. 26, 2014

(30) Foreign Application Priority Data

Dec. 25, 2012 (TW) ..... 101225080 U

(51) Int. Cl.
*A47H 1/14* (2006.01)

(52) U.S. Cl.
CPC ..... *A47H 1/14* (2013.01); *Y10S 160/903* (2013.01)
USPC ..... 160/323.1; 160/23.1; 160/903

(58) Field of Classification Search
CPC ..... A47H 1/14
USPC ..... 160/19, 23.1, 38, 323.1, 902, 903; 248/262, 267
See application file for complete search history.

(56) References Cited

U.S. PATENT DOCUMENTS 3,999,663 A * 12/1976 Walter et al. ..... 211/175
4,139,043 A * 2/1979 Donofrio ..... 160/236
4,157,108 A * 6/1979 Donofrio ..... 160/263
4,254,813 A * 3/1981 Vecchiarelli ..... 160/19
4,567,930 A * 2/1986 Fischer ..... 160/166.1
5,040,316 A * 8/1991 Fast ..... 40/124.4
5,127,459 A * 7/1992 Markowitz ..... 160/263
5,203,395 A * 4/1993 Koller et al. ..... 160/263
5,296,964 A * 3/1994 Shopp ..... 359/443
5,515,901 A * 5/1996 Hall ..... 160/206
5,533,560 A * 7/1996 Morris ..... 160/178.1 R
6,148,894 A * 11/2000 Judkins ..... 160/177 R
6,471,177 B1 * 10/2002 Emrick et al. ..... 248/544
6,843,299 B2 * 1/2005 Judkins ..... 160/178.1 R
6,935,401 B2 * 8/2005 Fraczek et al. ..... 160/321
7,134,469 B2 * 11/2006 Drew et al. ..... 160/38
D557,115 S * 12/2007 Zakowski ..... D8/354
D557,116 S * 12/2007 Zakowski ..... D8/354
7,367,536 B1 * 5/2008 Anderson et al. ..... 248/251
7,441,582 B2 * 10/2008 Lukos ..... 160/23.1
7,458,409 B1 * 12/2008 Sadowski ..... 160/38
7,836,937 B2 * 11/2010 Anderson et al. ..... 160/170
7,854,419 B2 * 12/2010 Ng et al. ..... 248/269
7,900,680 B2 * 3/2011 Garmyn et al. ..... 160/23.1
8,418,742 B2 * 4/2013 Anderson et al. ..... 160/308
8,480,048 B2 * 7/2013 Krantz-Lilienthal ..... 248/267
8,505,865 B2 * 8/2013 Wills et al. ..... 248/266
D700,831 S * 3/2014 Ng et al. ..... D8/380

(Continued)

*Primary Examiner* — Katherine Mitchell
*Assistant Examiner* — Justin Rephann
(74) *Attorney, Agent, or Firm* — Guice Patents PLLC

(57) ABSTRACT

A roller curtain fixing bracket assembly includes a left support, a right support, a decoration board and two cover boards covering the left and right supports. A roller curtain device can be installed between the main bodies of the left and right supports. Each of the left and right supports has a plane board main body and several fixing boards protruding from outer edges of the plane board main body. Front edge of each of two fixing boards extending from two sides of the plane board main body is formed with a split. The decoration board has a horizontal panel and a vertical panel. A top end and a certain section of the vertical panel are formed with hook bars inserted and latched in the splits of the left and right supports and assembled therewith. The cover boards serve to conceal the seams between the supports and the decoration board.

3 Claims, 12 Drawing Sheets

(56) References Cited

U.S. PATENT DOCUMENTS

| | | | | |
|---|---|---|---|---|
| D700,832 | S * | 3/2014 | Ng et al. | D8/380 |
| D700,833 | S * | 3/2014 | Ng et al. | D8/380 |
| 8,695,681 | B2 * | 4/2014 | Daniels | 160/323.1 |
| 2002/0166643 | A1 * | 11/2002 | Anderson et al. | 160/168.1 V |
| 2003/0015301 | A1 * | 1/2003 | Killo et al. | 160/310 |
| 2005/0205216 | A1 * | 9/2005 | Vrielink | 160/23.1 |
| 2006/0289120 | A1 * | 12/2006 | Pielmeier | 160/23.1 |
| 2008/0041534 | A1 * | 2/2008 | Jensen | 160/174 R |
| 2008/0289775 | A1 * | 11/2008 | Lukos | 160/242 |
| 2009/0308547 | A1 * | 12/2009 | Kwak | 160/368.1 |
| 2010/0263811 | A1 * | 10/2010 | Gao | 160/368.1 |
| 2011/0132556 | A1 * | 6/2011 | Kao | 160/368.1 |
| 2011/0139381 | A1 * | 6/2011 | Daniels | 160/298 |
| 2013/0319624 | A1 * | 12/2013 | Cannaverde | 160/405 |

* cited by examiner

ROLLER CURTAIN FIXING BRACKET ASSEMBLY

BACKGROUND OF THE INVENTION

1. Field of the Invention

The present invention relates generally to a roller curtain fixing bracket assembly for installing a roller curtain device thereon, and more particularly to a roller curtain fixing bracket assembly, which is able to stabilize the raising/lowering operation of the roller curtain and beautify the appearance of the roller curtain as well as protect the roller curtain.

2. Description of the Related Art

Currently, a roller curtain is installed in such a manner that two supports are mounted on two sides of a window and the roller curtain device is directly installed on the supports. A protection board is further mounted on the supports for covering the roller curtain. In raising/lowering operation of the roller curtain, a pull force is applied to the supports. It often takes place that the supports cannot bear the pull force and detach from the wall face and drop down. Therefore, the above fixing structure can hardly securely fix the roller curtain on the wall face. Moreover, the protection board is simply hung on the supports so that the protection board can be hardly securely mounted on the supports.

SUMMARY OF THE INVENTION

It is therefore a primary object of the present invention to provide a roller curtain fixing bracket assembly, which enables a user to quickly install a roller curtain device and is able to beautify the appearance of the roller curtain. The roller curtain fixing bracket assembly includes a left support, a right support, a decoration board and two cover boards covering the left and right supports. A roller curtain device can be installed between the main bodies of the left and right supports. Each of the left and right supports has a plane board main body and several fixing boards perpendicularly protruding from outer edges of the plane board main body. Front edge of each of two fixing boards extending from two sides of the plane board main body is formed with a split. The decoration board has a horizontal panel and a vertical panel. A top end and a certain section of the vertical panel are formed with hook bars, which are directly inserted and latched in the splits of the left and right supports and assembled therewith. In addition, by means of the holes of the fixing boards of the left and right supports, the left and right supports are respectively fixedly mounted on the wall faces of two sides of a window. The roller curtain device is installed between inner faces of the left and right supports and positioned above the window and concealed by the decoration board so as to achieve a beautiful appearance. In addition, the main bodies of the left and right supports are formed with two sets of fixing holes in horizontal direction and vertical direction. According to the requirements of different windows, the roller curtain device can be fixed in a horizontal state or a vertical state. Therefore, the position of the roller curtain can be changed to provide different sunshine shading effects.

The present invention can be best understood through the following description and accompanying drawings, wherein:

DETAILED DESCRIPTION OF THE PREFERRED EMBODIMENTS

Figure 1:
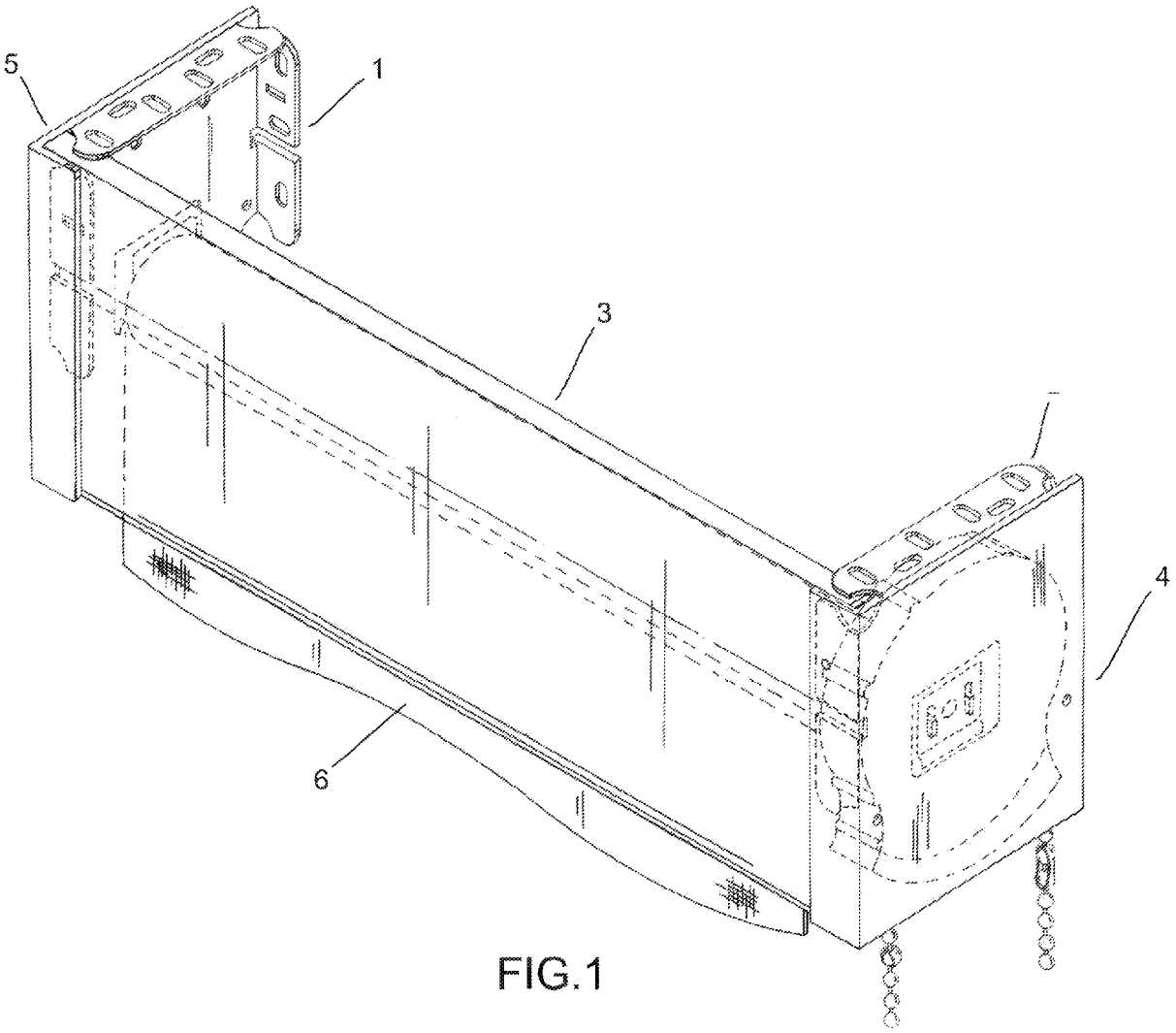
FIG. 1 is a perspective assembled view of the present invention.
Figure 2:
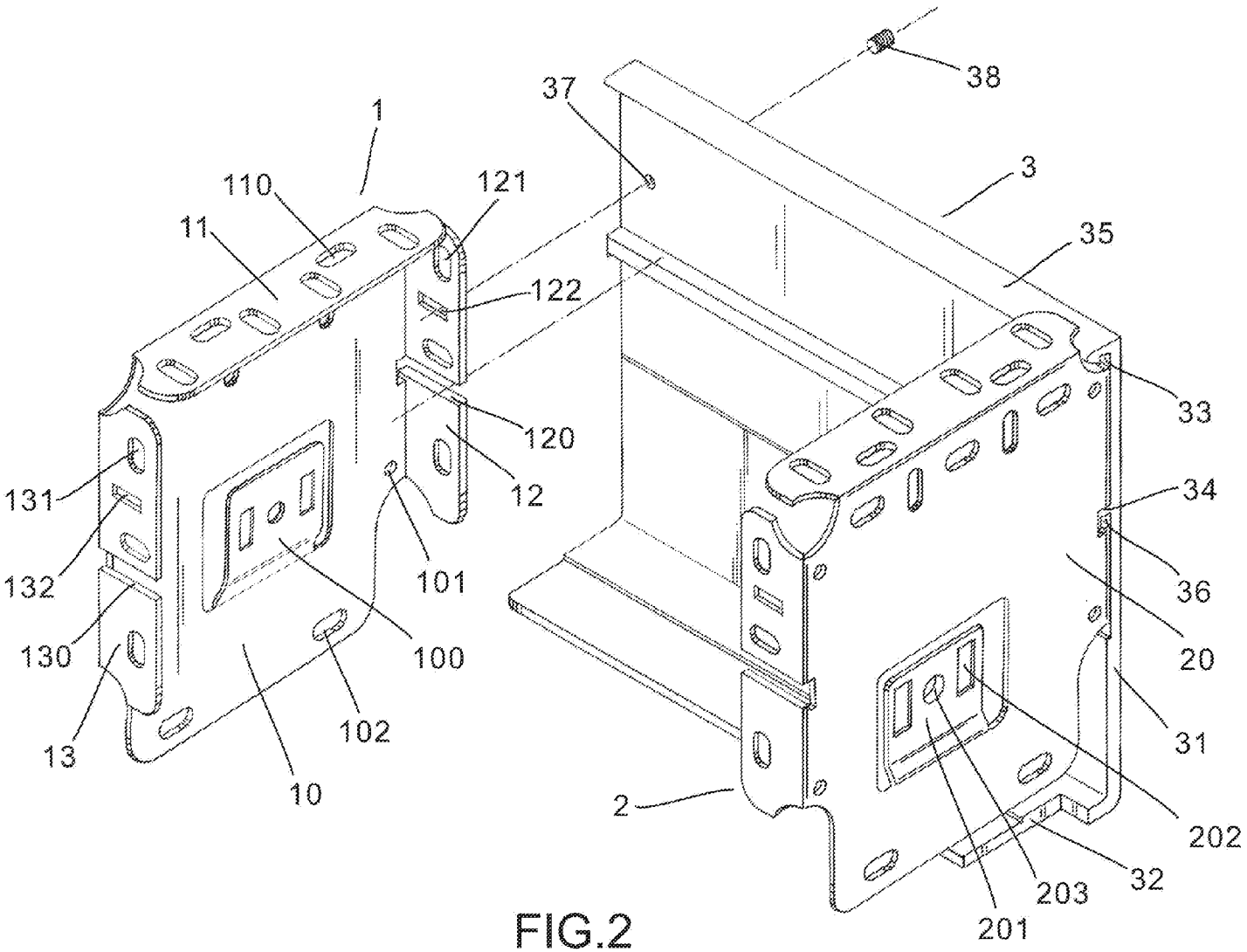
FIG. 2 is a perspective exploded view of the present invention.

Please refer to FIGS. 1 to 6, which show a first embodiment of the present invention. According to the first embodiment, the roller curtain fixing bracket assembly of the present invention includes a left support 1, a right support 2, a decoration board 3, two cover boards 4, 5 and a roller curtain device 6 disposed between the left and right supports 1, 2 (as shown in FIG. 1). The left and right supports 1, 2 have identical structures and can be commonly used (as shown in FIG. 2). Each of the left and right supports 1, 2 has a plane board main body 10 and several fixing boards 11, 12, 13 perpendicularly protruding from outer edges of the plane board main body 10. The plane board main body 10 is formed with several threaded holes 101 and through holes 102. A center of the plane board main body 10 is formed with a fixing member 100, 201 for inserting the roller curtain device 6. The fixing member 100, 201 integrally extends from the plane board main body 10 in a bending form. The fixing member 100, 201 is formed with several slots 202 and a central circular hole 203 for inserting and fixing the roller curtain device 6. Front edges of two lateral fixing boards 12, 13 of the plane board main body 10 are formed with splits 120, 130. In addition, slots 121, 131 and slots 122, 132 corresponding to the decoration board 3 are formed on upper and lower sides of the splits 120, 130.

The decoration board 3 is connectable with the left and right supports 1, 2. The decoration board 3 includes a vertical panel 31 and a horizontal panel 32. Both the vertical panel 31 and the horizontal panel 32 are stepped structures with different thickness. The top end and a certain section of the vertical panel 31 are formed with hook bars 34, 35 integrally extending from the vertical panel 31 to define recessed spaces 33, 36. In addition, a through hole 37 is formed on the vertical panel 31 between the hook bars 34, 35 for a fixing screw 38 to pass through. The through hole 37 is aligned with the slots 122, 132 of the fixing boards 12, 13 of the left and right supports 1, 2.

Figure 3:
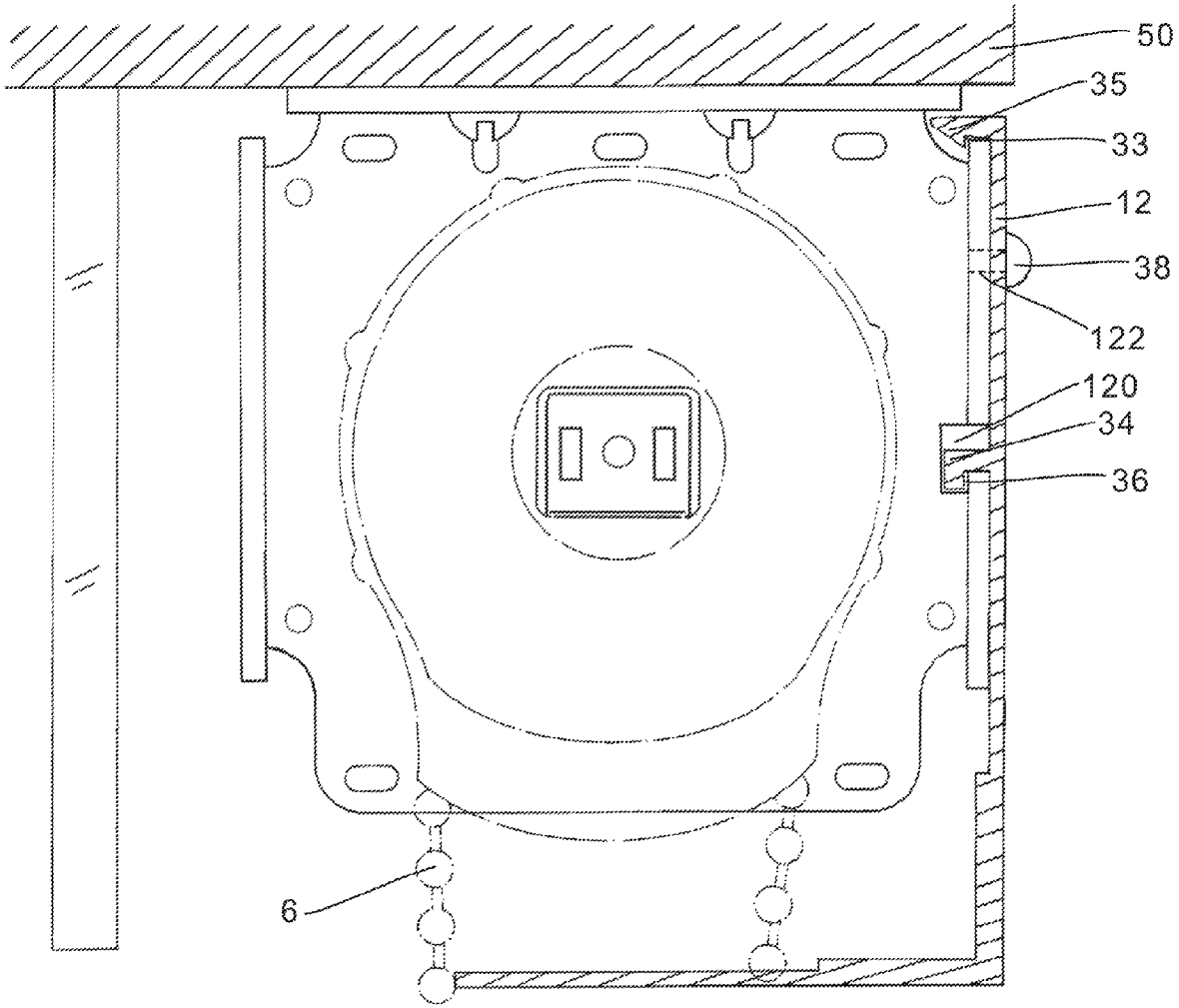
FIG. 3 is a sectional assembled view of the present invention.
Figure 4:
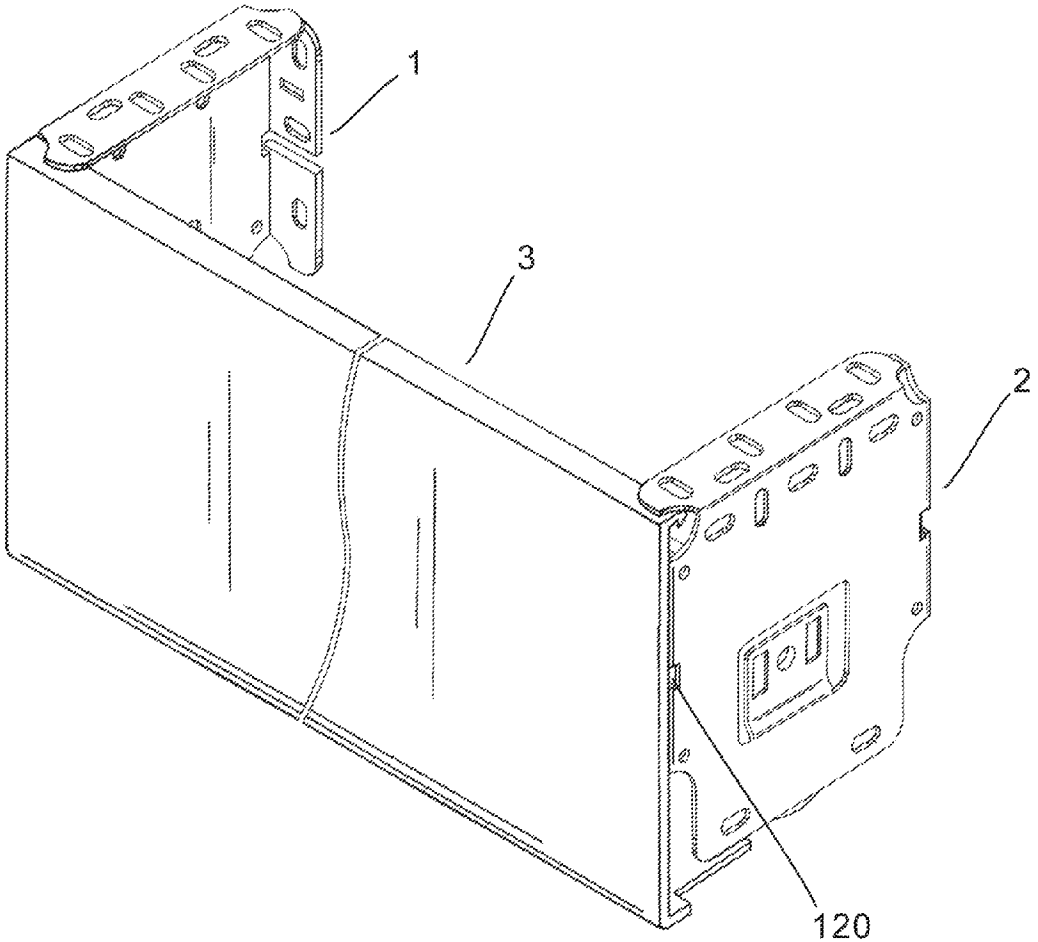
FIG. 4 is a perspective assembled view of the decoration board of the present invention.

Referring to FIGS. 3 and 4, when assembled, the hook bars 34, 35 of the decoration board 3 are inserted into the splits 120, 130 of the left and right supports 1, 2 and then downward latched and hung to make the recessed spaces 33, 36 of the hook bars 34, 35 bridged over the thickness of the splits 120, 130 and assembled therewith. Then the fixing screw 38 is screwed to enhance the assembling/fixing force between the left and right supports 1, 2 and the decoration board 3.

Figure 5:
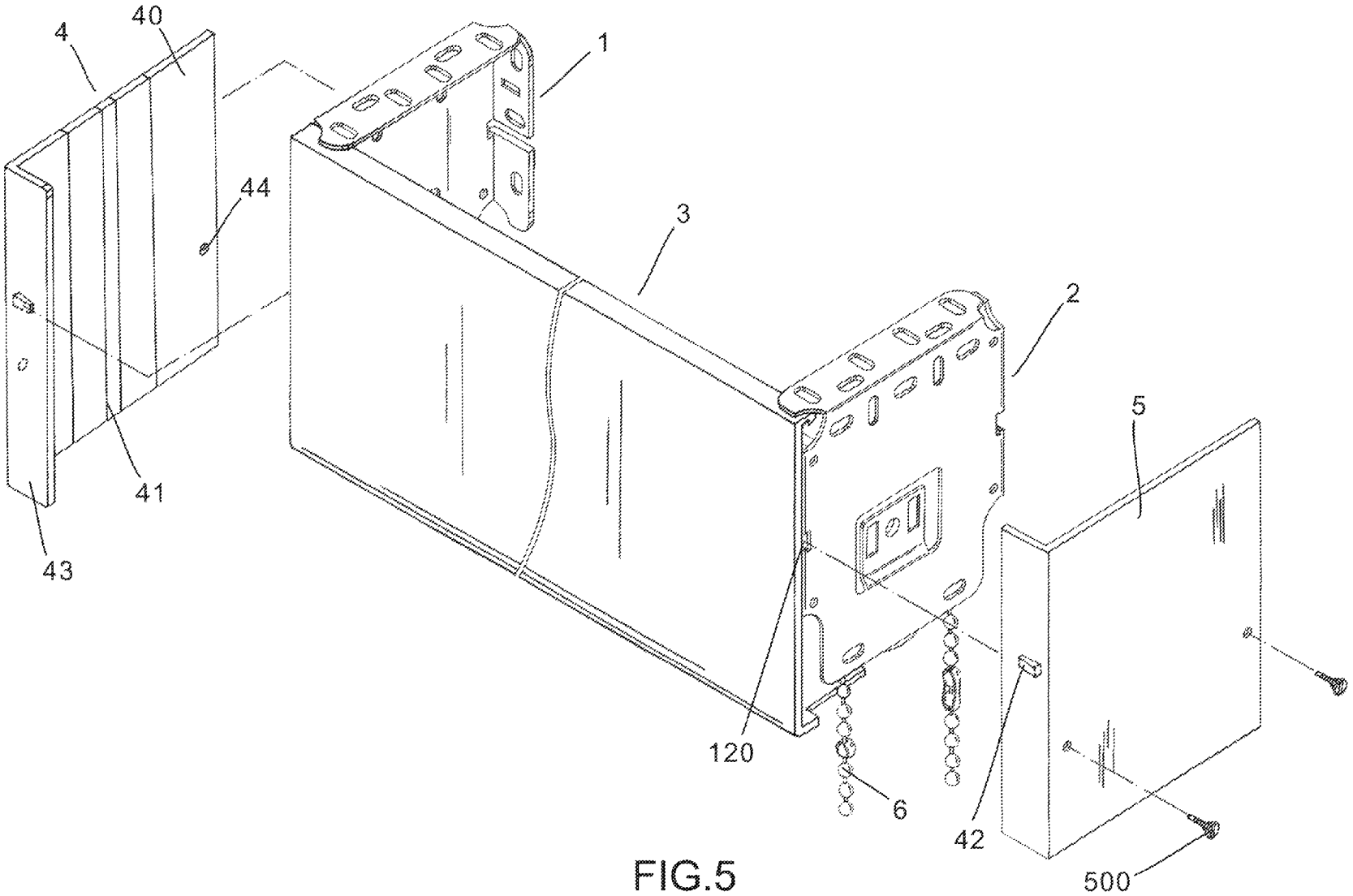
FIG. 5 is a perspective exploded view of the cover boards of the present invention.

After the left and right supports 1, 2 are assembled and connected with the decoration board 3, the two cover boards 4, 5 cover outer ends of the left and right supports 1, 2 (as shown in FIG. 5). The front end of the cover board 4 is formed with a bending section 43. The main body of the cover board 4 is formed with several breaking lines 41, whereby the cover board 4 can be broken along the breaking line 41 to shorten the length of the cover board 4. An engagement block 42 is formed on an inner face of the cover board 4 corresponding to the splits 120 of the left and right supports 1, 2, whereby the cover board 4 can be conveniently plug-in connected with the left and right supports 1, 2. A screw 500 can be used to lock the cover board 4 with the left and right supports 1, 2 from outer side.

Figure 6:
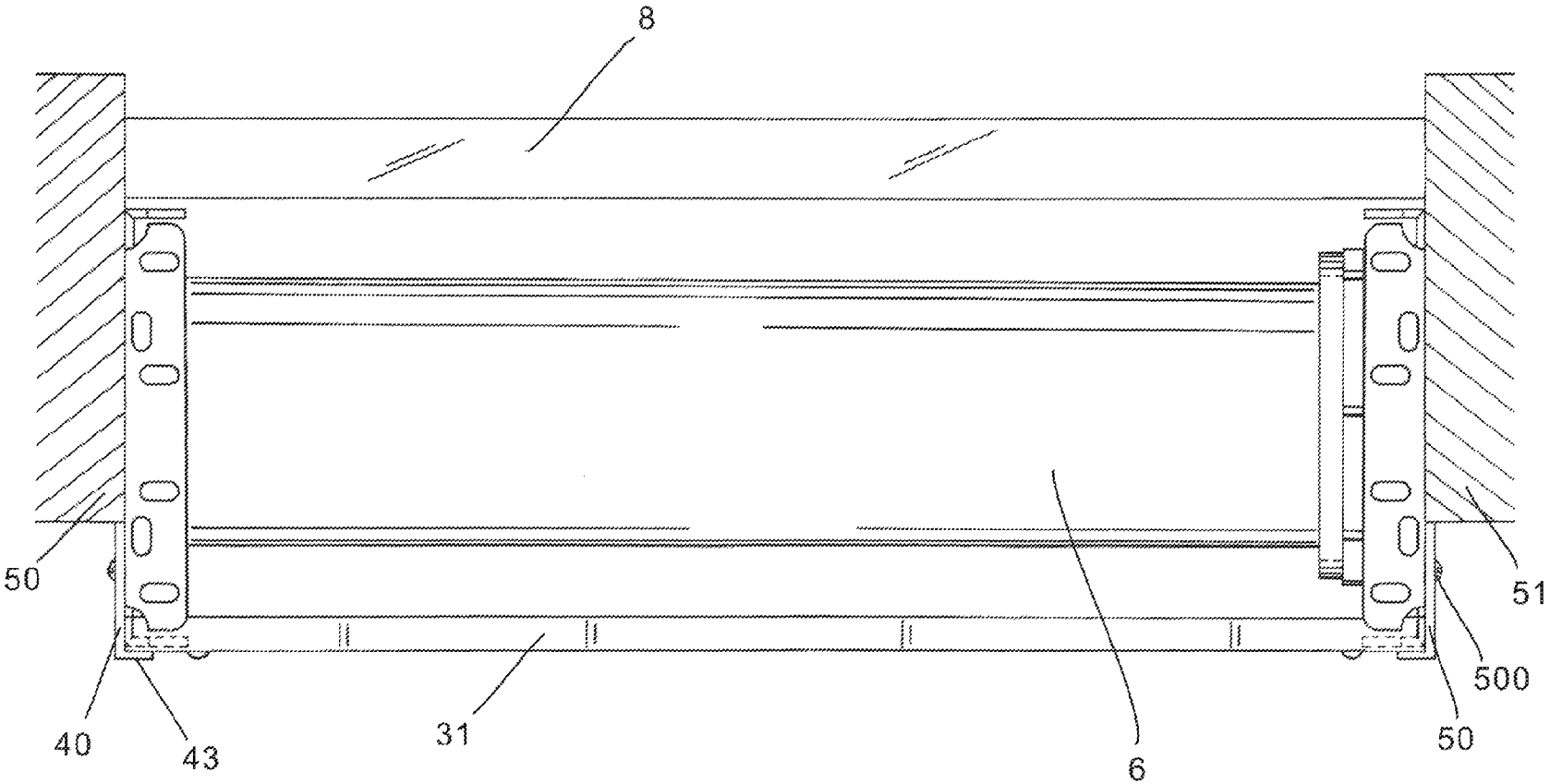
FIG. 6 is a sectional assembled view of the cover boards of the present invention.

After the left and right supports 1, 2 are assembled with the decoration board 3, the cover boards 4, 5 are broken along the breaking line 41 according to the depth of the wall face to make the cover boards 4, 5 flush with the wall face, whereby the cover boards 4, 5 can snugly cover the left and right supports 1, 2. The bending sections 43 serve to conceal the seams between the left and right supports 1, 2 and the decoration board 3 to complete the structure as a whole. In this case, the roller curtain device 6 can be installed on an upper side of a window 8 (as shown in FIG. 6).

Figure 7:
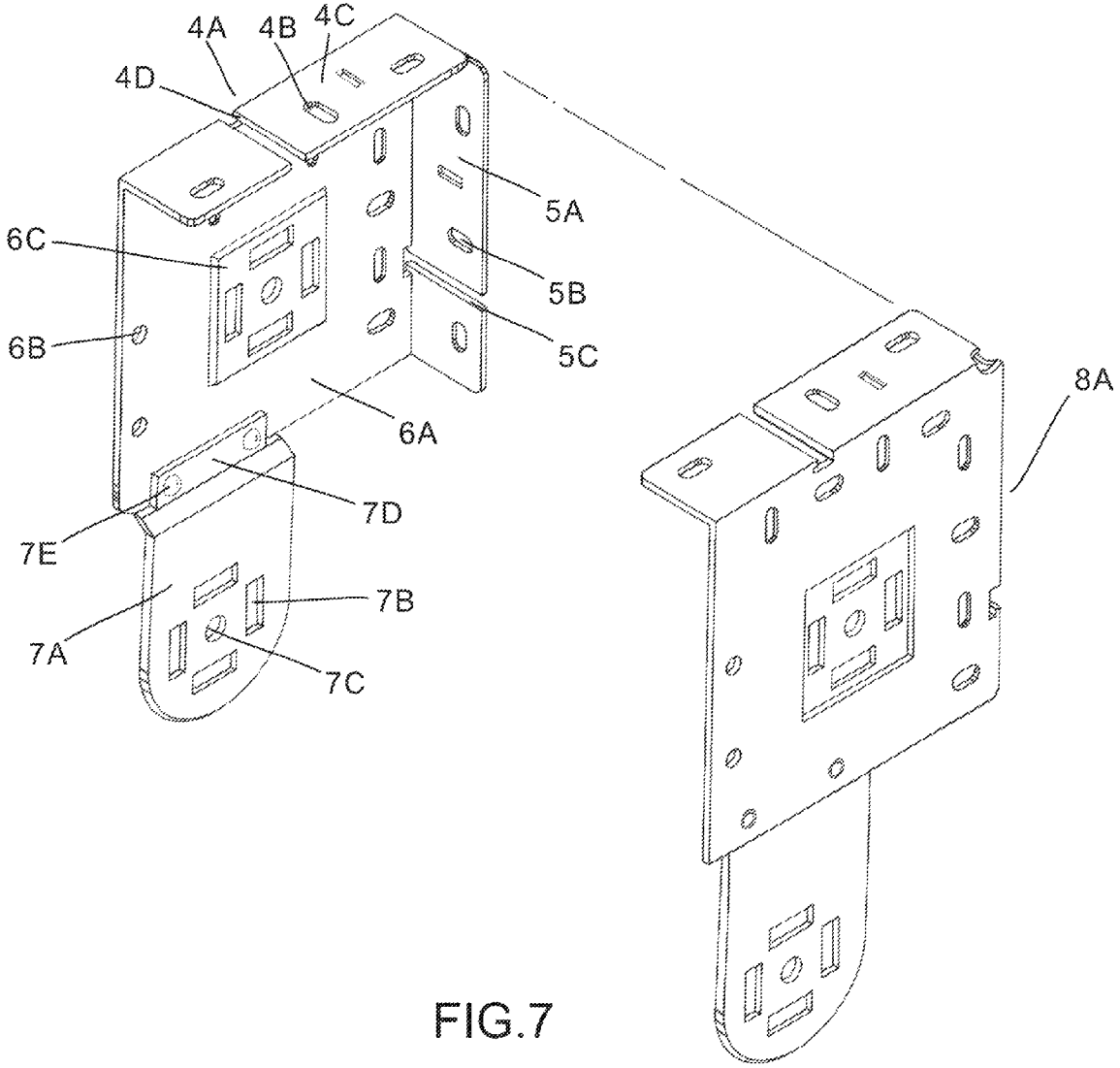
FIG. 7 is a perspective exploded view of a second embodiment of the fixing bracket assembly of the present invention.
Figure 8:
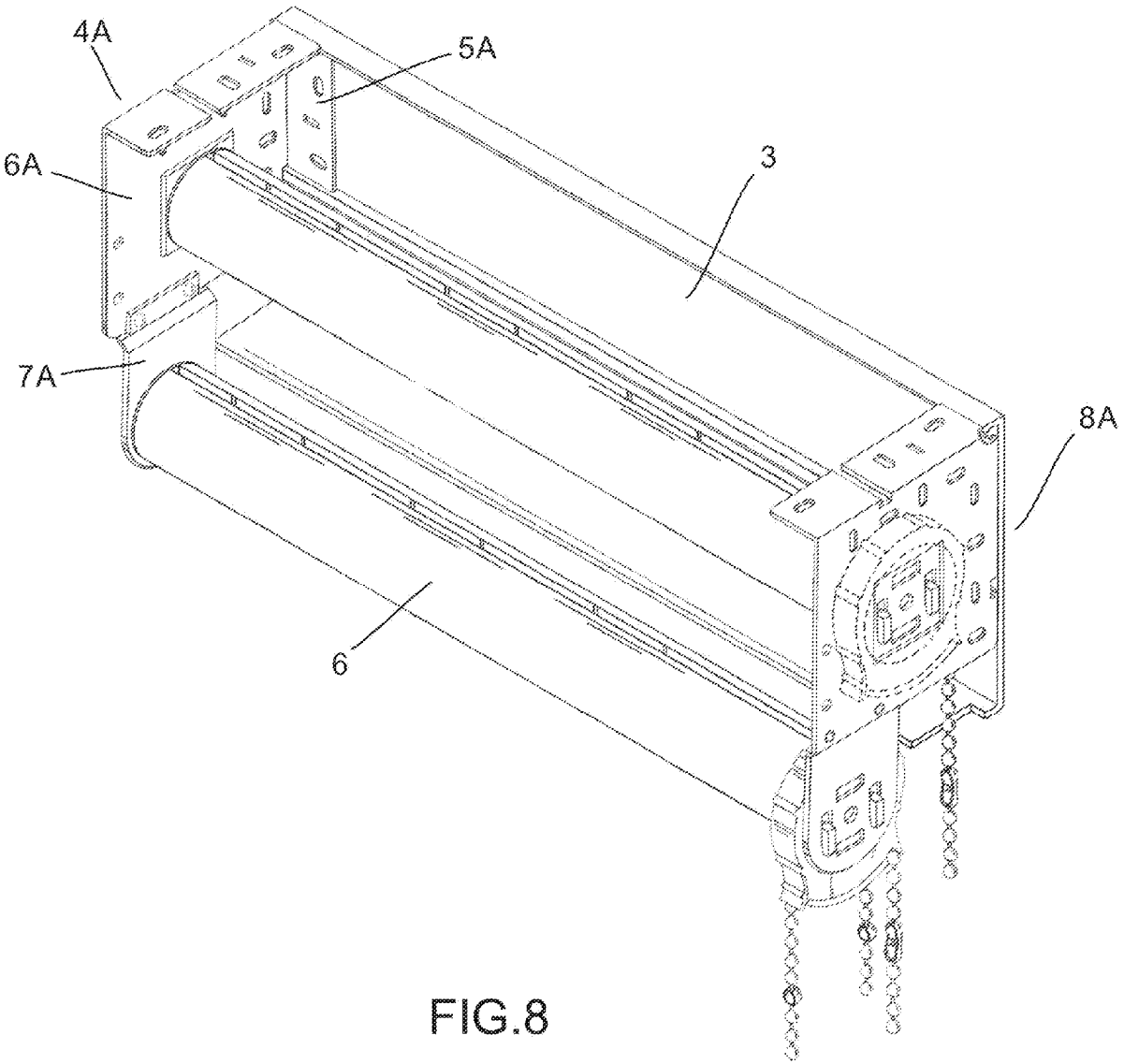
FIG. 8 is a perspective view showing the installation of the second embodiment of the fixing bracket assembly of the present invention.
Figure 9:
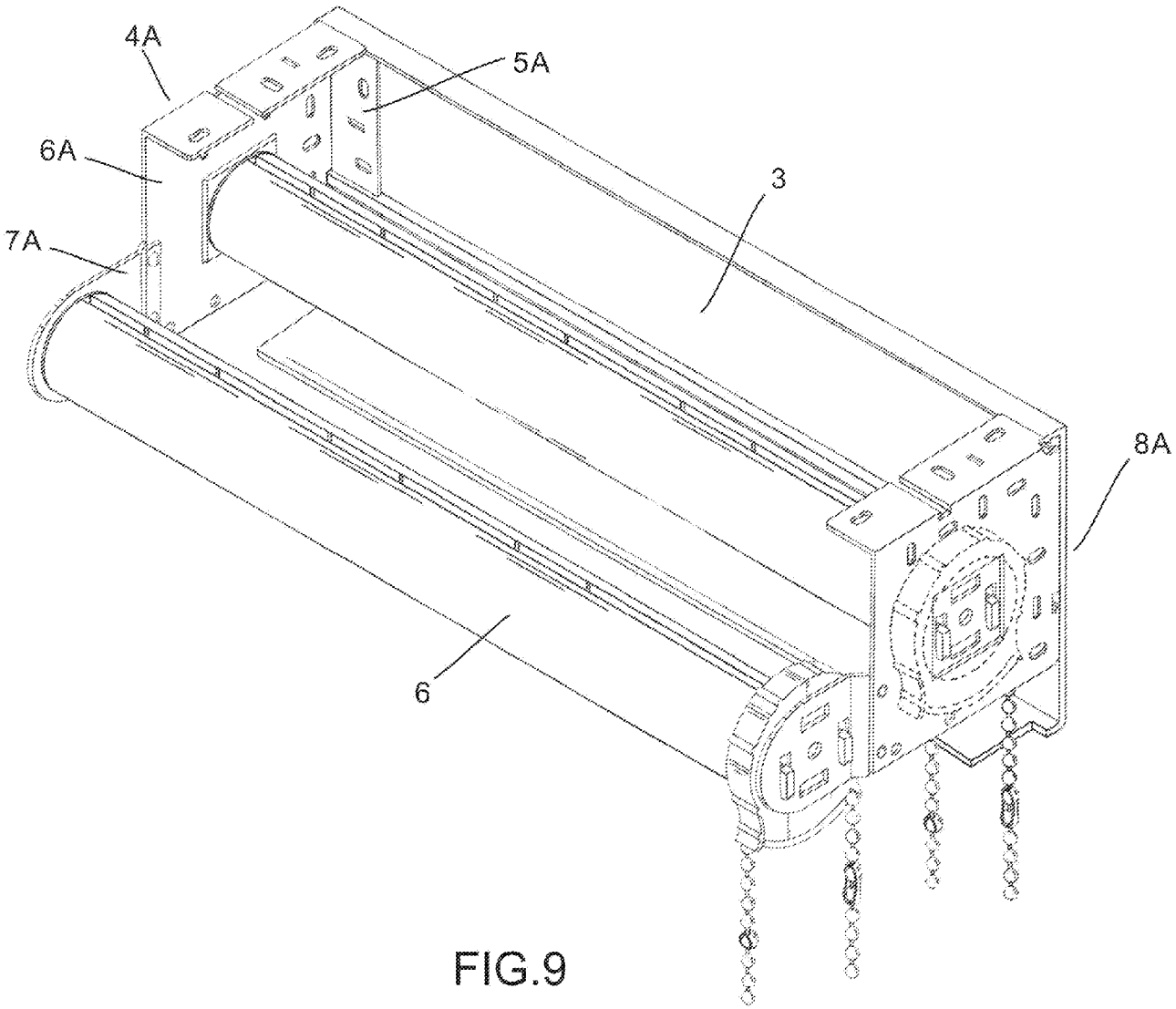
FIG. 9 is a perspective view showing the installation of the second embodiment of the fixing bracket assembly of the present invention in another state.

Please now refer to FIGS. 7 and 8, which show a second embodiment of the roller curtain fixing bracket assembly of the present invention. The second embodiment includes a left support 4A and a right support 8A for connecting with the decoration board 3. The left and right supports 4A, 8A can be commonly used. The left support 4A has a main body 6A and fixing boards 4C, 5A respectively protruding from two sides of the main body 6A. The fixing boards 4C, 5A are also formed with through holes 4B, 5B and splits 4D, 5C for mounting the decoration board 3. The center of the main body 6A has a fixing seat 6C raised from the main body 6A by a certain height, whereby the roller curtain device 6 can be fixed and located between the two supports 4A, 8A. In addition, two sets of through holes 6B are respectively formed on a lateral side and a lower side of the main body 6A. A connection board 7A has a slot 7B and a central circular hole 7C. The front end of the connection board 7A has a locating board 7D. The locating board 7D is connected with the main body 6A by means of rivets 7E passing through the slot 7B and the circular hole 7C. Accordingly, an additional roller curtain device 6 can be horizontally or vertically fixed on the connection board 7A as necessary to provide double-layer roller curtain hanging/supporting function (as shown in FIGS. 8 and 9).

Figure 10:
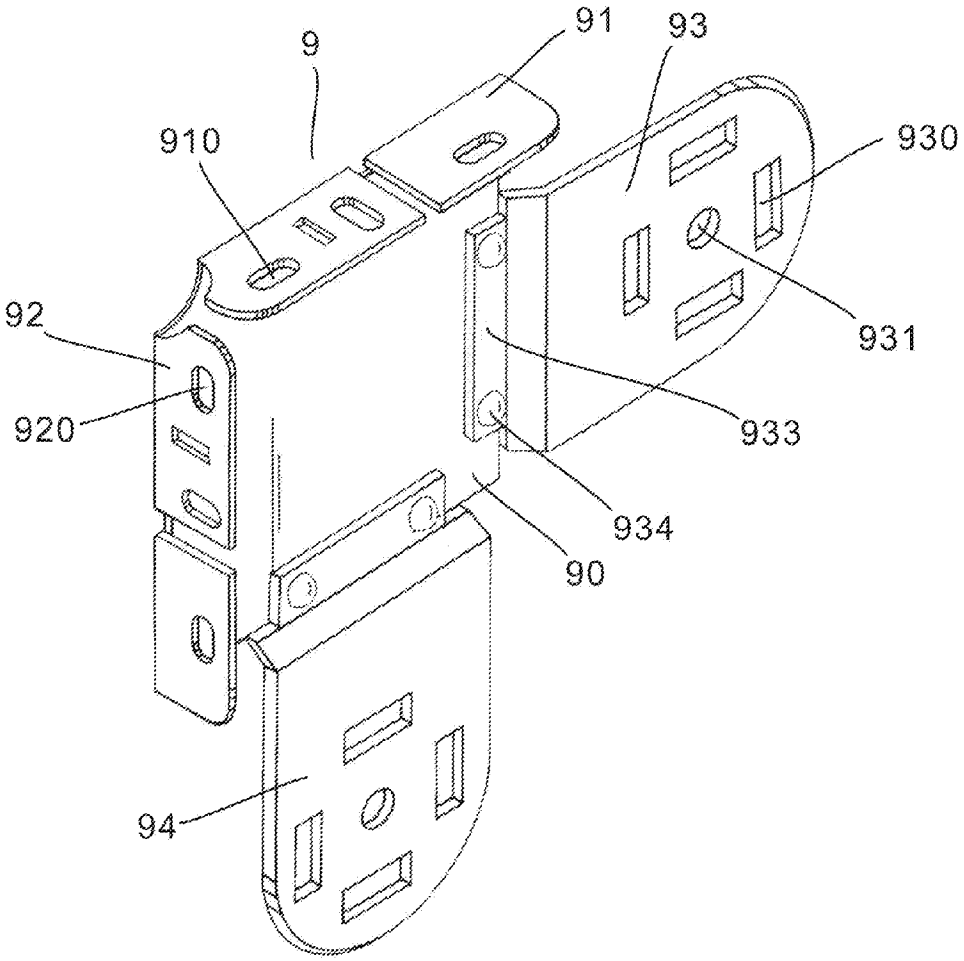
FIG. 10 is a perspective assembled view of a third embodiment of the fixing bracket assembly of the present invention.

Please now refer to FIG. 10, which shows a third embodiment of the roller curtain fixing bracket assembly 9 of the present invention. The third embodiment includes a main body 90 and fixing boards 91, 92 extending from the main body 90 in a bending form and connection boards 93, 94 horizontally and vertically fixed on the main body 90. The fixing boards 91, 92 are formed with several through holes 910, 920. Rivets 934 are passed through the locating board 933 protruding from the front end of the connection board 93 to horizontally and vertically fix the connection boards 93, 94 on the main body 90. The can also provide double-layer roller curtain hanging/supporting function.

Figure 11:
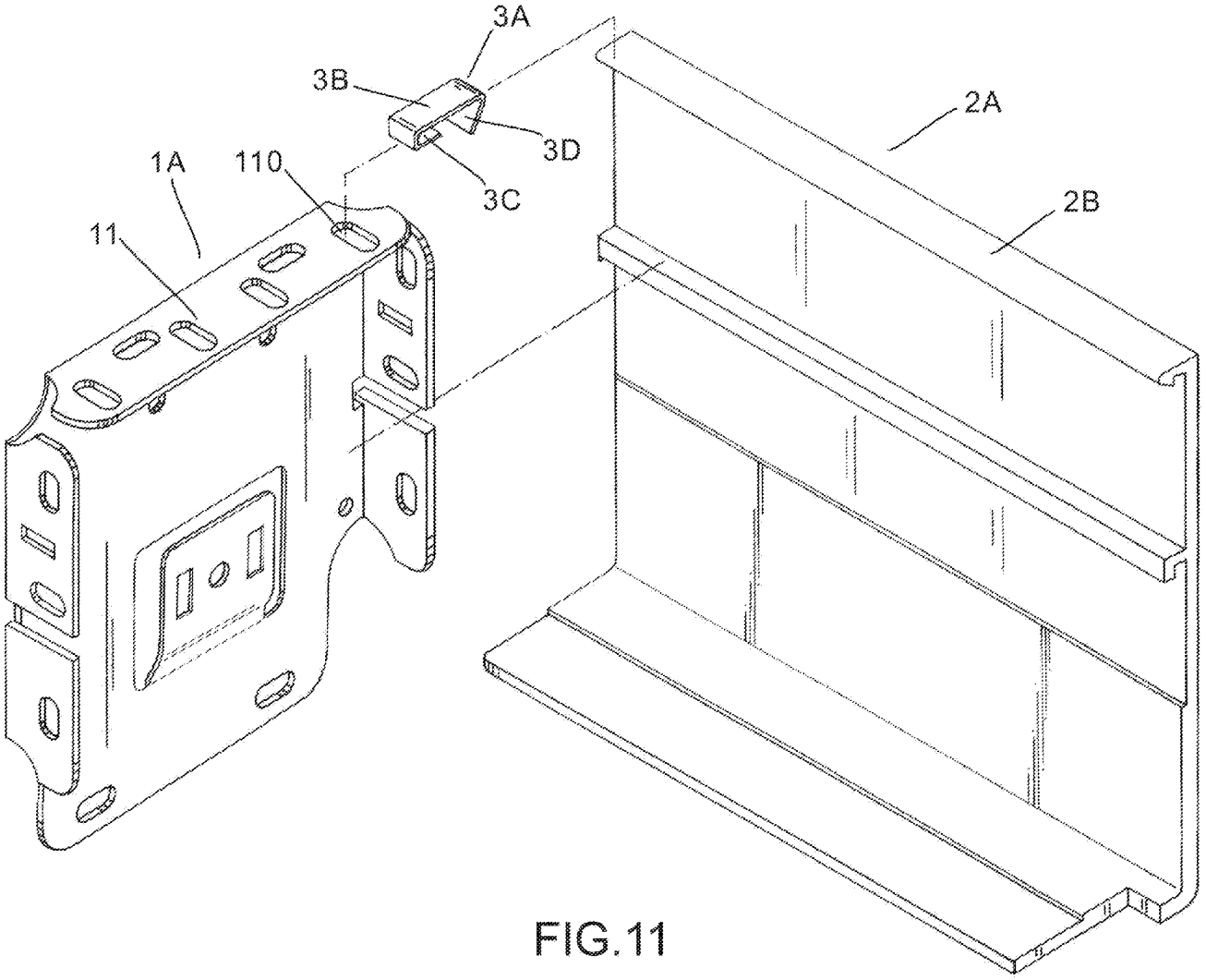
FIG. 11 is a perspective exploded view of a fourth embodiment of the fixing bracket assembly of the present invention.
Figure 12:
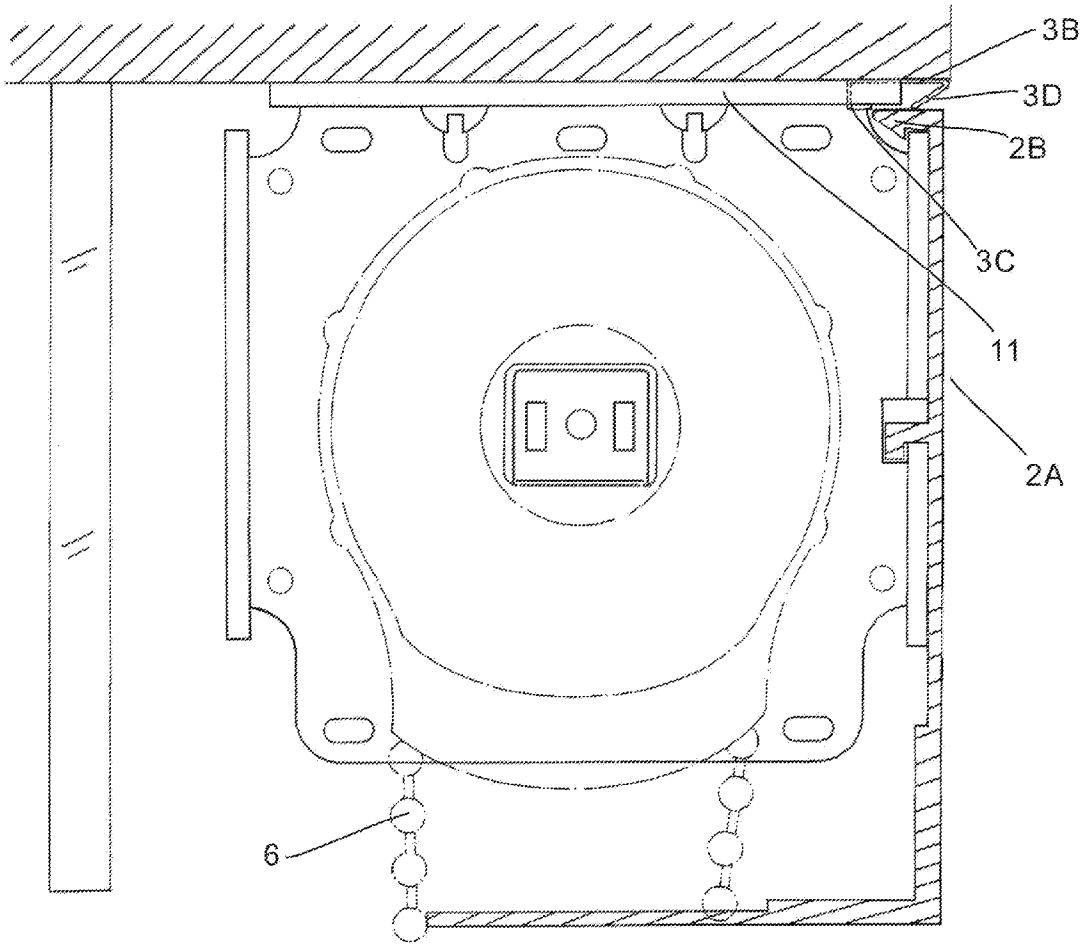
FIG. 12 is a sectional assembled view of the fourth embodiment of the fixing bracket assembly of the present invention.

Please now refer to FIGS. 11 and 12, which show a fourth embodiment of the roller curtain fixing bracket assembly of the present invention. The fourth embodiment also includes a left support 1A and a right support (not shown) for connecting with the decoration board 2A. The left and right supports can be commonly used. In this embodiment, fixing leaf springs 3A are respectively latched with the left and right supports 1A and the decoration board 2A to connect the left and right supports 1A and the decoration board 2A with each other. The fixing leaf spring 3A includes a horizontal board body 3B, a hook section 3C and an oblique plate body 3D. The hook section 3C is fixedly hooked in the through hole 110 of the fixing board 11 with the horizontal board body 3B outward protruding from the support 1A. When the hook bar 2B of the upper end of the decoration board 2A is connected with the support 1A, the upper face of the hook bar 2B will upward push the oblique plate body 3D of the fixing leaf spring 3B. Accordingly, the oblique plate body 3D will apply a downward pressing force to enhance the connection between the decoration board 2A and the support 1A instead of the fixing screw (as shown in FIG. 12).

The above embodiments are only used to illustrate the present invention, not intended to limit the scope thereof. Many modifications of the above embodiments can be made without departing from the spirit of the present invention.

What is claimed is:

1. A roller curtain fixing bracket assembly comprising:

a left support and a right support, each support of the left support and the right support has a plane board main body having several threaded holes and several fixing boards perpendicularly protruding from outer edges of the plane board main body, two lateral fixing boards of the several fixing boards are located on opposing lateral sides of the plane board main body, each lateral fixing board of the two lateral fixing boards of the several fixing boards has a split extending from a front edge to a rear edge of thereof and the split is positioned perpendicular to the plane board main body;

a decoration board having a horizontal panel and a vertical panel, the vertical panel has a top hook bar located on a top end thereof and defining a top hook recess space and a middle hook located on a middle section thereof and defining a middle hook recess space, the decoration board is connected to a single lateral fixing board of the two lateral fixing boards of the left support and the right support, the top hook bar is located above a top edge of the single lateral fixing board and the top edge of the single lateral fixing board is positioned in the top hook recess space and the middle hook bar is inserted into the split of the single lateral fixing board and a bottom edge of the split is positioned in the middle hook recess space;

two cover boards, each cover board of the two cover boards has a horizontal panel and a vertical panel connected to the horizontal panel, the horizontal panel of each of the two cover boards covering outer ends of the left support and the right support respectively and the vertical panel of the two cover boards covering end portions of the decoration board respectively, an inner face of the horizontal panel being formed with several breaking lines located parallel with an inner face of the vertical panel, a length of the horizontal panel is capable of being shortened by breaking the horizontal panel at a desired breaking line of the several breaking lines to position the vertical panel adjacent to a corresponding end portion of the decoration board and to position an outer end of the horizontal panel flush with a wall face, the outer end of the horizontal panel and the vertical panel are located on opposing ends of the horizontal panel; and two fixing leaf springs, each fixing leaf spring of the two fixing leaf springs has a board body, a hook section located at a first end of the board body and an oblique plate body located at a second end of the board body, the hook section of each said fixing leaf spring of the two fixing leaf springs is connected to a through hole of an upper most fixing board of the several fixing boards of a corresponding support of the left support and the right support, the board body of each said fixing leaf spring of the two fixing leaf springs is located above the upper most fixing board of the several fixing boards of the corresponding support of the left support and the right support and the oblique plate body of each said fixing leaf spring of the two fixing leaf springs is pressing downwardly against a top of the top hook bar of the decoration board.

2. The roller curtain fixing bracket assembly as claimed in claim 1, wherein the split of each lateral fixing board of the two lateral fixing boards downwardly extends through the fixing board into an end face of the plane board main body.

3. The roller curtain fixing bracket assembly as claimed in claim 1, further comprising two connection boards, one connection board of the two connection boards is connected to each support of the left support and the right support for installing a roller curtain device.

* * * * *